US006953131B2

(12) United States Patent
Devine

(10) Patent No.: US 6,953,131 B2
(45) Date of Patent: Oct. 11, 2005

(54) MINT ROLL PACKAGE

(75) Inventor: Daniel Devine, Rockton, IL (US)

(73) Assignee: Cadbury Adams USA LLC, Rye Brook, NY (US)

( * ) Notice: Subject to any disclaimer, the term of this patent is extended or adjusted under 35 U.S.C. 154(b) by 244 days.

(21) Appl. No.: 10/637,425

(22) Filed: Aug. 8, 2003

(65) Prior Publication Data

US 2005/0029282 A1 Feb. 10, 2005

(51) Int. Cl.[7] ..... B65G 59/00
(52) U.S. Cl. ..... 221/246; 221/289
(58) Field of Search ..... 221/289, 263, 221/266, 65, 246

(56) References Cited

U.S. PATENT DOCUMENTS

| | | | | |
|---|---|---|---|---|
| 3,159,308 A | * | 12/1964 | Passavanti | 221/289 |
| 3,166,216 A | * | 1/1965 | Guarr | 221/289 |
| 3,409,172 A | * | 11/1968 | Fuglsang-Madsen et al. | 221/229 |
| 3,815,734 A | * | 6/1974 | Kruckel | 206/443 |
| 4,749,106 A | * | 6/1988 | von Schuckmann et al. | 222/96 |
| 5,897,025 A | * | 4/1999 | Flewitt et al. | 221/257 |
| D491,805 S | * | 6/2004 | Loth et al. | D9/422 |

FOREIGN PATENT DOCUMENTS

| | | | | |
|---|---|---|---|---|
| FR | 2643881 A1 | * | 9/1990 | A61J/1/03 |

* cited by examiner

*Primary Examiner*—Donald P. Walsh
*Assistant Examiner*—Kaitlin Joerger
(74) *Attorney, Agent, or Firm*—Robert G. Crouch; Marsh Fischmann & Breyfogle LLP

(57) ABSTRACT

A package assembly 10 for the storage and distribution of a plurality of stacked mints 12 is provided. The package assembly 10 includes a cylindrical outer shell 14 including a shell sidewall 16, a shell bottom surface 18, and a shell open top 20. The shell sidewall 16 includes a sidewall inner surface 22 and a sidewall outer surface 24. A vertical control slot 28 is formed in the shell sidewall 16, the vertical control slot 28 having a control slot height 40 and a control slot width 42. At least one retention protrusion 78 is formed onto a slot side edge 34 such that the control slot width 42 is reduced in the location of the at least one retention protrusion 78. A cylindrical inner insert 26 including an insert sidewall 44, an insert top surface 46, and an insert open bottom 48, is formed to house the plurality of stacked mints 12. The cylindrical inner insert 26 is positioned within the cylindrical outer shell 14 such that the insert open bottom 48 faces the shell bottom surface 18. A control pad 52 is formed onto and protrudes outwards from the insert sidewall 44. The control pad 52 is positioned within the vertical control slot 28 and is movable such that the cylindrical inner insert 26 can be moved between a closed position 68 and an open position 70. The control pad 52 has a control pad width 54 such that said control pad 52 engages the at least one retention protrusion 78 when in the closed position 68 and such that the cylindrical inner insert 26 is resisted from moving into the open position 70. A dispensing chamber 72 is formed in the insert sidewall 44 adjoining the insert top surface 46. The dispensing chamber 72 is covered by the shell sidewall 16 when the cylindrical inner insert 26 is in the closed position 68. The dispensing chamber 72 is positioned outside the cylindrical outer shell 14 when the cylindrical inner insert 26 is in the open position 70. The dispensing chamber 72 has a dispensing chamber height 74 sufficient to allow one of the plurality of stacked mints 12 to be removed from the cylindrical inner insert 26.

20 Claims, 3 Drawing Sheets

MINT ROLL PACKAGE

TECHNICAL FIELD

The present invention relates generally to a package for the storage and distribution of mints and similar candy and more specifically a package for the storage and distribution of mints with improved manufacturing and assembly characteristics.

BACKGROUND OF THE INVENTION

Packaging can no longer be treated as simply a utilitarian element utilized to bring a product to market. Appearance, ease of use, shape, configuration, and a variety of other packaging characteristics have been found to effect a customer's perception of the product contained within. Consumers may also attribute the perceived quality of the packaging with the product contained within. Additionally, the unique aspects of a packaging design and its unique functions can develop consumer identity that may further promote product sales.

As a result of such considerations, packaging design has taken on an increased significance to product manufacturers. Unique designs and dispensing features, in the case of mints or candy, can often result in complex packing designs. This may result in complex or time consuming manufacturing that may negatively impact the cost associated with a product's distribution. If these costs are passed on to the consumer, they may in turn negatively impact the perception of the product or its value. It is therefore of great import to develop packaging assemblies that may be produced with simple cost effective methods while continuing to provide novelty of function and unique perceptions to consumers.

It would therefore be highly desirable to have a new packaging assembly for the distribution of mints or other candies. It would further be highly desirable to have a packaging assembly with improved manufacturing and assembly characteristics.

SUMMARY OF THE INVENTION

In accordance with the present invention a package assembly for the storage and distribution of a plurality of stacked mints is provided. The package assembly includes a cylindrical outer shell including a shell sidewall, a shell bottom surface, and a shell open top. The shell sidewall includes a sidewall inner surface and a sidewall outer surface. A vertical control slot is formed in the shell sidewall, the vertical control slot having a control slot height and a control slot width. At least one retention protrusion is formed onto a slot side edge such that the control slot width is reduced in the location of the at least one retention protrusion. A cylindrical inner insert including an insert sidewall, an insert top surface, and an insert open bottom, is formed to house the plurality of stacked mints. The cylindrical inner insert is positioned within the cylindrical outer shell such that the insert open bottom faces the shell bottom surface. A control pad is formed onto and protrudes outwards from the insert sidewall. The control pad is positioned within the vertical control slot and is movable such that the cylindrical inner insert can be moved between a closed position and an open position. The control pad has a control pad width such that said control pad engages the at least one retention protrusion when in the closed position and such that the cylindrical inner insert is resisted from moving into the open position. A dispensing chamber is formed in the insert sidewall adjoining the insert top surface. The dispensing chamber is covered by the shell sidewall when the cylindrical inner insert is in the closed position. The dispensing chamber is positioned outside the cylindrical outer shell when the cylindrical inner insert is in the open position. The dispensing chamber has a dispensing chamber height sufficient to allow one of the plurality of stacked mints to be removed from the cylindrical inner insert.

Other objects and features of the present invention will become apparent when viewed in light of the detailed description and preferred embodiment when taken in conjunction with the attached drawings and claims.

DESCRIPTION OF PREFERRED EMBODIMENTS

Figure 1:
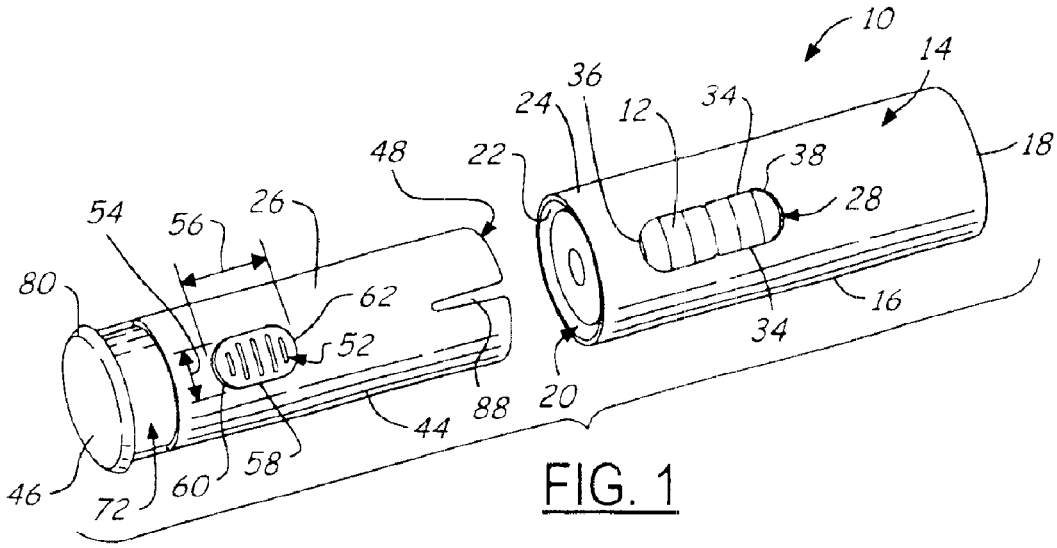
FIG. 1 is an exploded view of a package assembly in accordance with the present invention.

Referring now to FIG. 1, which is an illustration of a package assembly 10 for the storage and distribution of a plurality of stacked mints 12 in accordance with the present invention. The package assembly 10 is intended for the storage and distribution of stacked mints 12 or other similar candies. It is contemplated, however, that the present invention may be utilized for the storage and distribution of a variety of products. The package assembly 10 includes a cylindrical outer shell 14 including a shell sidewall 16, a shell bottom surface 18, and a shell open top 20. The shell sidewall 16 includes a sidewall inner surface 22 and a sidewall outer surface 24. Although the cylindrical outer shell 14 can be formed in a variety of fashions, one embodiment contemplates an injection molded cylindrical outer shell 14.

Figure 2:
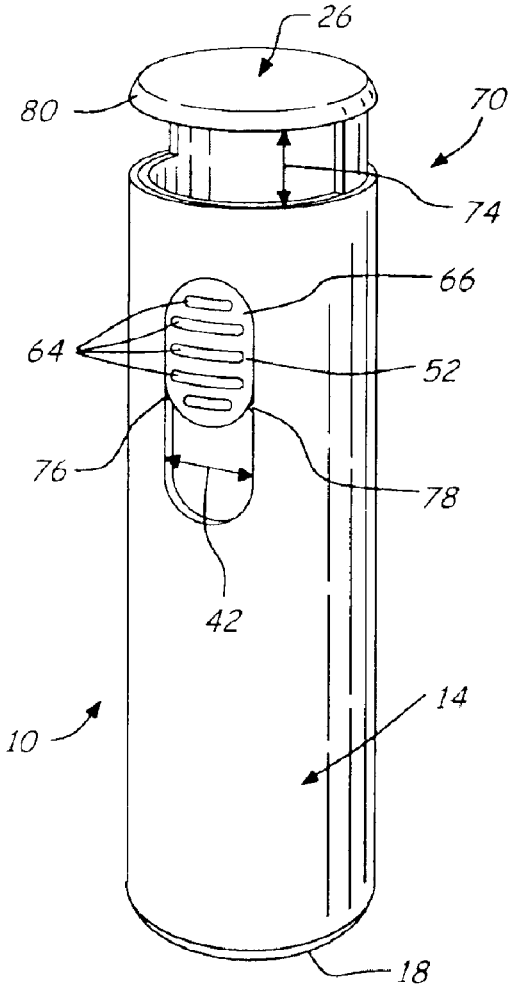
FIG. 2 is an illustration of the package assembly illustrated in FIG. 1, the cylindrical inner insert illustrated in the open position.
Figure 4:
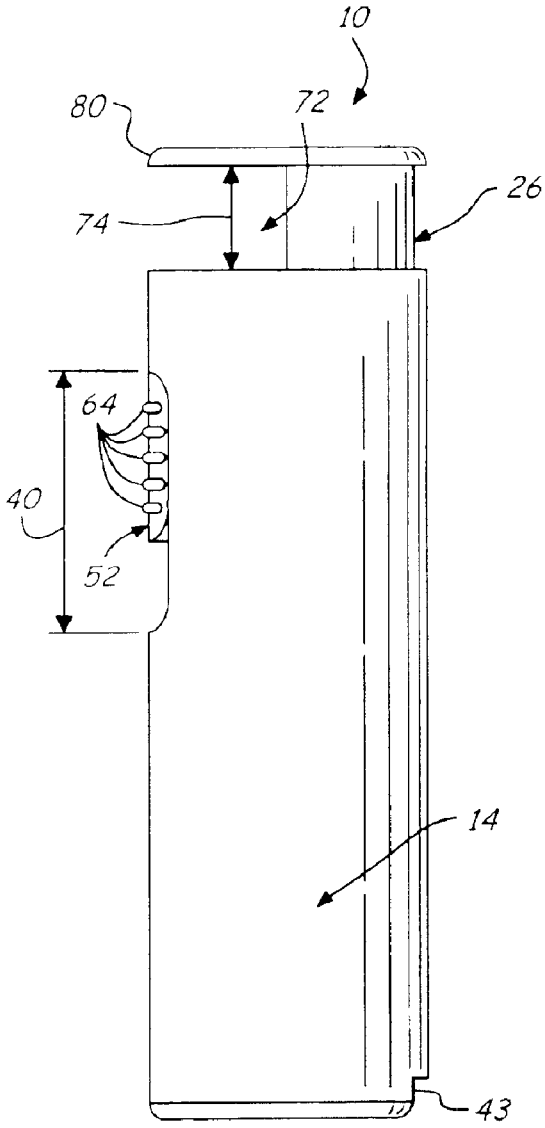
FIG. 4 is a side view illustration of the package assembly illustrated in FIG. 3.
Figure 5:
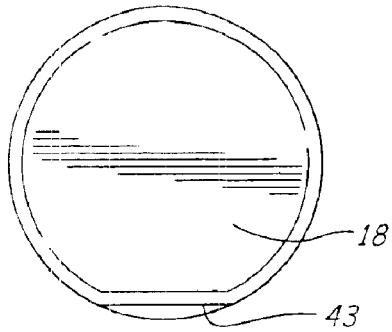
FIG. 5 is a bottom view illustration of the package assembly illustrated in FIG. 3.

The cylindrical outer shell 14 works in concert with a cylindrical inner insert 26 to provide a simple two-piece injected molded assembly 10 for the storage and distribution of the stacked mints 12. In order to accommodate the interaction, the cylindrical outer shell 14 includes a vertical control slot 28 formed in the shell sidewall 16 and connecting the sidewall outer surface 24 to the sidewall inner surface 22. The vertical control slot 28 includes a pair of slot-side edges 34, an upper slide edge 36, and a lower side edge 38. Although the vertical control slot 28 may be formed in a variety of shapes, one embodiment contemplates the use of straight slot-side edges 34, a rounded upper slide edge 36, and a rounded lower slide edge 38. The vertical control slot 28 includes a control slot height 40 (see FIG. 4) and a control slot width 42 (see FIG. 2). An auto-fill ridge 43 (see FIGS. 4 and 5) may be formed in cylindrical outer shell 14 to facilitate automated assembly and filling of the plurality of stacked mints 12.

The cylindrical inner insert 26 includes an insert sidewall 44, an insert top 46, and an insert open bottom 48. The cylindrical inner insert 26 is positioned within the cylindrical outer shell 14 such that the insert open bottom 48 faces the shell bottom surface 18. This forms a closed storage compartment 50 for the storage of the plurality of stacked mints 12 (see FIG. 6). The cylindrical inner insert 26 engages the cylindrical outer shell 48 by way of a control pad 52 formed onto and protruding outwards from the insert sidewall 44. When the cylindrical inner insert 26 is positioned within the cylindrical outer shell 14, the control pad 52 is positioned within the vertical control slot 28 and is slidably movable vertically within the vertical control slot 28. The control pad 52 preferably has a control pad width 54 approximately equal to the control slot width 42 and a control pad height 56 less than the control slot height 40. In this fashion, movement of the control pad 52 is limited to the vertical direction. The control pad 52 is preferably shaped to compliment the vertical control slot 28 having straight pad sidewalls 58, a rounded pad upper edge 60, and a rounded pad lower edge 62. This provides seamless movement of the control pad 52 within the vertical control slot 28. A plurality of grip ridges 64 may be formed on the outer surface 66 of the control pad 52 to facilitate movement of the control pad 52.

Figure 3:
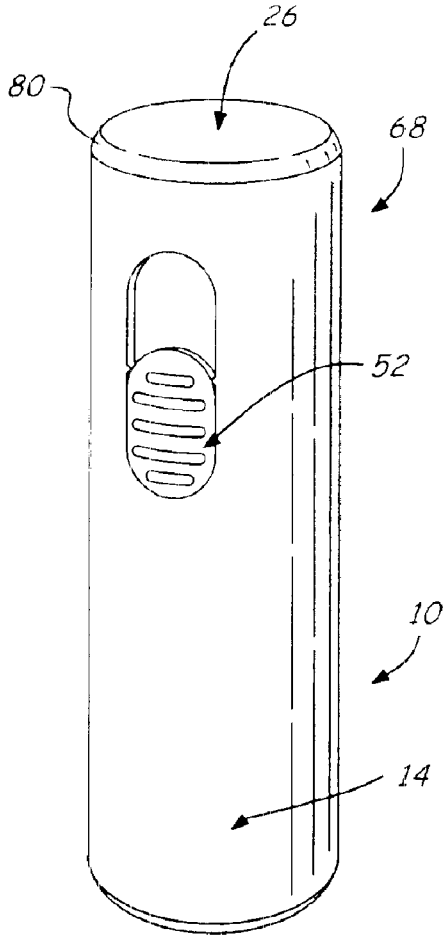
FIG. 3 is an illustration of the package assembly illustrated in FIG. 1, the cylindrical inner insert illustrated in the closed position.

The control pad 52 is movable from a position in communication with the lower side end 38 to a position in communication with the upper side end 36. This in turn moves the cylindrical inner insert 26 from a closed position 68 (see FIG. 2) to an open position 70 (see FIG. 3). The cylindrical inner insert 24 includes a dispensing chamber 72 formed in the insert sidewall 44 adjoining the insert top surface 46. The dispensing chamber 72 is positioned within the cylindrical outer shell 14 when the cylindrical inner insert 24 is in the closed position 68. The dispensing chamber 72 is positioned outside of the cylindrical outer shell 14 when the cylindrical inner insert 24 is in the open position 70. This dispensing chamber 72 has a dispensing chamber height 74 (see FIG. 4) sufficient to allow one of the plurality of stacked mints 12 to be removed from the cylindrical inner insert 24 when in the open position 70. The preferably size of the dispensing chamber height 74 is such that it is greater than the width of a single mint 12 but less than two mints such that only a single mint is dispensed. It is contemplated that the package assembly 10 may be turned such that gravity may draw the plurality of stacked mints 12 into the dispensing chamber 72 for dispensing. Although a variety of dispensing chambers 72 are contemplated, one embodiment utilizes a half transverse section 76 (see FIG. 6) removed from a portion of the insert sidewall 44.

Although the dimensional control of the dispensing chamber 72 maybe controlled by the dispensing chamber height 74, it may also be controlled as a function of the difference between the control slot height 40 and the control pad height 56. The difference between these two dimensions can be used to control the distance the cylindrical inner insert 26 protrudes from the cylindrical outer shell 14 when in the open position 70. When used in combination with a preformed dispensing chamber height 74, this can provide a flush improved appearance. When utilized without a non-precise dispensing chamber height 74, this dimensional control may be utilized to control the amount of dispensing chamber 72 exposed and thereby generate an effective dispensing chamber height 74 of desired proportions.

It is often desirable that the cylindrical inner insert 26 be held in either the open position 70 or the closed position 68 without interaction from the operator. Resistance from movement out of the closed position 68 prevents unwanted dispensation in pockets or purses. Resistance from movement out of the open position 70 promotes ease of dispensation for the user. The present invention therefore includes at least one retention element 78, such as a protrusion, formed to generate frictional resistance to movement of the cylindrical inner insert 26. Although a variety of retention protrusions 78 are contemplated, one embodiment utilizes a pair of retention protrusions 78 formed onto the slot-side edges 34. The retention protrusions 78 thereby reduced the control slot width 42 and thereby engage the control pad 52 when in either the open position 70, the closed position 68, or both. The use of such retention protrusions 78 allows for a simplistic control feature to be molded into the cylindrical outer shell 14 without added expense.

Figure 7:
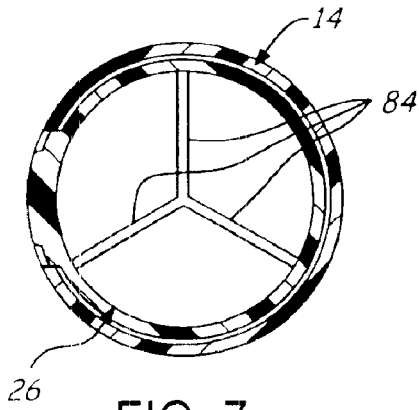
FIG. 7 is a transverse cross-sectional view of the package assembly illustrated in FIG. 6, the cross-section taken along the lines 7—7 in the direction of the arrows.
Figure 8:
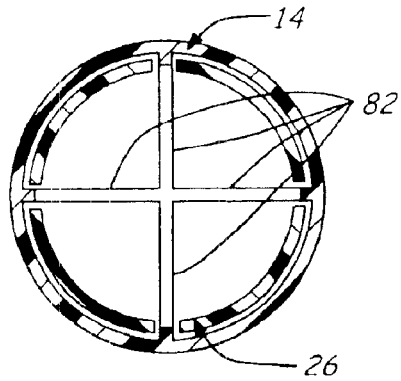
FIG. 8 is a transverse cross-sectional view of the package assembly illustrated in FIG. 6, the cross-section taken along the lines 8—8 in the direction of the arrows.

Additional features may be molded into the cylindrical outer shell 14 or the cylindrical inner insert 26 to add further features to the present invention. An upper flange section 80 may be molded onto the insert top surface 60 such that the insert top surface 60 mates cleanly with the shell open top 20. This can be utilized to prevent mint dust from entering the package assembly 10 or dirt from entering the package assembly 10 when the cylindrical inner insert 26 is in the closed position 68. A plurality of lower reinforcement arms 82 (see FIG. 8) may be formed onto the shell bottom surface 18 and a plurality of upper reinforcement arms 84 (see FIG. 7) may be formed onto insert top surface 46 in order to strengthen the package assembly 10 and allow for a broader range of materials to be utilized in construction. Although a wide variety of reinforcement arms 82 are contemplated, one embodiment contemplates a cross-shaped plurality of lower reinforcement arm 82.

Figure 6:
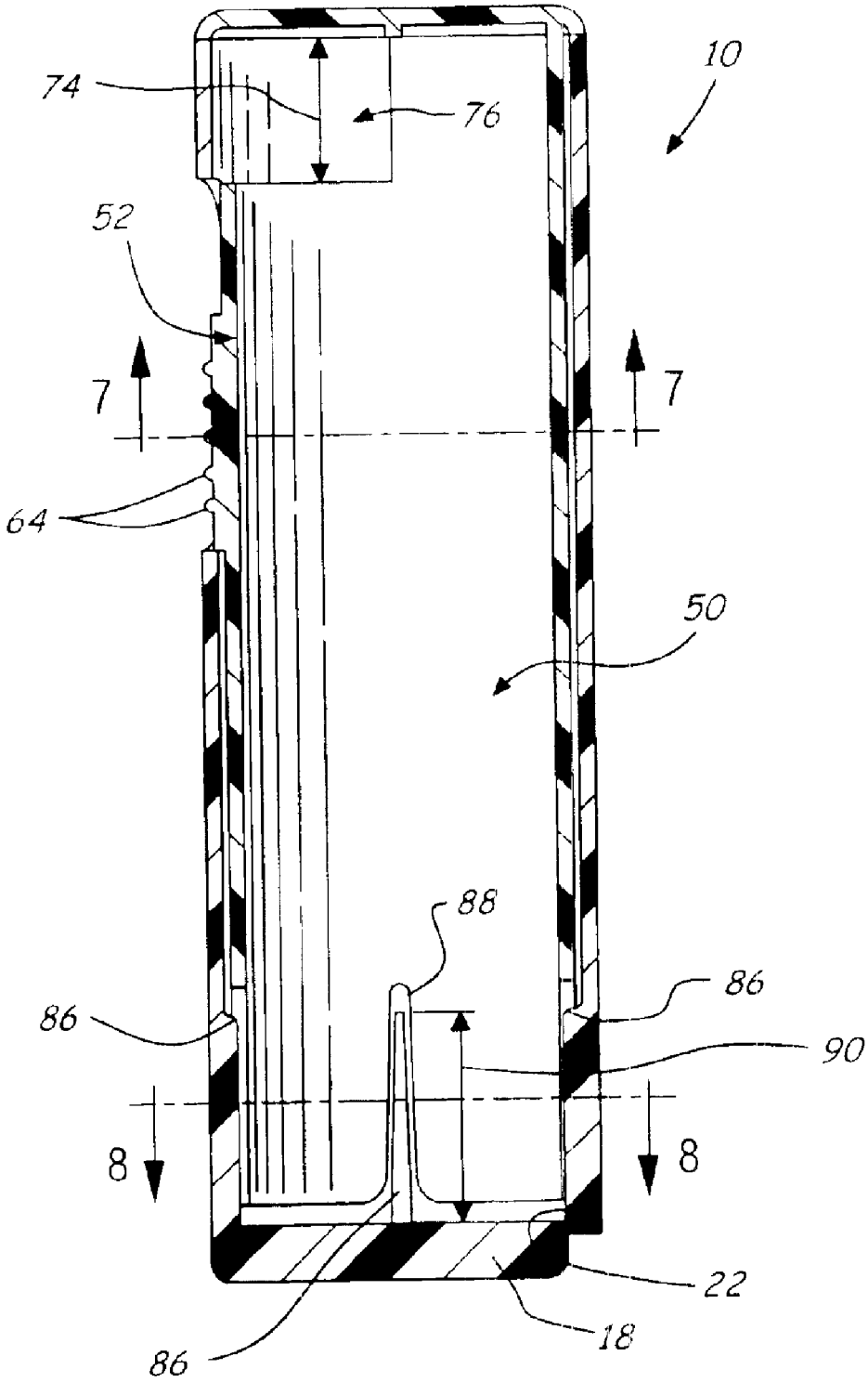
FIG. 6 is a longitudinal cross-sectional view of the package assembly illustrated in FIG. 3.

One or more vertical arm guides 86 may be extended longitudinally on the sidewall inner surface 22 from the plurality of lower reinforcement arms 82 (see FIG. 6). These vertical arm guides 86 are designed to engage alignment slots 88 formed into the cylindrical inner insert 26 to prevent rotation of the cylindrical inner insert 26 within the cylindrical outer shell 14. This prevents consumers from pressing too hard on the control pad 52 and rotating the cylindrical inner insert 26 out of position. It is preferable that the vertical arm guides 86 have a vertical arm height 90 sufficient to engage the alignment slots 88 when the cylindrical inner insert 26 is in the open position 70. This provides rotational prevention over the entire travel length of the cylindrical inner insert 26. This feature may additionally allow for the use of materials with flexibility suitably for automated assembly while preventing unwanted rotation due to such flexibility.

While the invention has been described in connection with one or more embodiments, it is to be understood that the specific mechanisms and techniques which have been described are merely illustrative of the principles of the invention, numerous modifications may be made to the methods and apparatus described without departing from the spirit and scope of the invention as defined by the appended claims.

What is claimed is:

1. A package assembly for the storage and distribution of a plurality of stacked mints comprising:

a cylindrical outer shell including a shell sidewall, a shell bottom surface, and a shell open top, said shell sidewall including a sidewall inner surface and a sidewall outer surface;

a vertical control slot formed in said shell sidewall, said vertical control slot having a control slot height and a control slot width, at least one retention protrusion formed onto a slot side edge such that said control slot width is reduced in the location of said at least one retention protrusion;

a cylindrical inner insert including an insert sidewall, an insert top surface, and an insert open bottom, said cylindrical inner insert formed to house the plurality of stacked mints, said cylindrical inner insert positioned within said cylindrical outer shell such that said insert open bottom faces said shell bottom surface;

a control pad formed onto and protruding outwards from said insert sidewall, said control pad positioned within said vertical control slot and movable such that said cylindrical inner insert can be moved between a closed position and an open position, said control pad having a control pad width such that said control pad engages said at least one retention protrusion when in said closed position such that said cylindrical inner insert is resisted from moving into said open position; and a dispensing chamber formed in said insert sidewall adjoining said insert top surface, said dispensing chamber covered by said shell sidewall when said cylindrical inner insert is in said closed position, and said dispensing chamber positioned outside said cylindrical outer shell when said cylindrical inner insert is in said open position, said dispensing chamber having a dispensing chamber height sufficient to allow one of the plurality of stacked mints to be removed from said cylindrical inner insert.

2. A package assembly as described in claim 1, wherein said control pad includes a control pad height, said control slot height greater than said control pad height by an amount equal to said dispensing chamber height.

3. A package assembly as described in claim 1, wherein said dispensing chamber comprises a half transverse section removed from a portion of said insert sidewall.

4. A package assembly as described in claim 1, further comprising:

an upper flange section formed around said insert top surface, said upper flange section engaging said shell open top when said cylindrical inner insert is in said closed position.

5. A package assembly as described in claim 1, further comprising:

a plurality of lower reinforcement arms formed on said shell bottom surface and in communication with said shell sidewall.

6. A package assembly as described in claim 5, further comprising:

a vertical arm guide extending longitudinally on said sidewall inner surface from one of said plurality of lower reinforcement arms; and an alignment slot formed longitudinally into said insert sidewall adjacent said insert open bottom, said alignment slot engaging said vertical arm guide such that said cylindrical inner insert cannot rotate within said cylindrical outer shell.

7. A package assembly as described in claim 6, wherein said vertical arm guide comprises a vertical arm height sufficient to engage said alignment slot when said cylindrical inner insert is in said open position.

8. A package assembly as described in claim 1, wherein said control pad includes a control pad height, said control slot height greater than said control pad height such that said dispensing chamber is exposed above said shell open top by an amount equal to one of the plurality of stacked mints when said cylindrical inner shell is in said open position.

9. A package assembly for the storage and distribution of a plurality of stacked mints comprising:

a cylindrical outer shell including a shell sidewall, a shell bottom surface, and a shell open top, said shell sidewall including a sidewall inner surface and a sidewall outer surface;

a vertical arm guide formed longitudinally onto said sidewall inner surface;

a vertical control slot formed in said shell sidewall, said vertical control slot having a control slot height and a control slot width;

a cylindrical inner insert including an insert sidewall, an insert top surface, and an insert open bottom, said cylindrical inner insert formed to house the plurality of stacked mints, said cylindrical inner insert positioned within said cylindrical outer shell such that insert open bottom faces said shell bottom surface;

a control pad formed onto and protruding outwards from said insert sidewall, said control pad positioned within said vertical control slot and movable such that said cylindrical inner insert can be moved between a closed position and an open position;

a dispensing chamber formed in said insert sidewall adjoining said insert top surface, said dispensing chamber covered by said shell sidewall when said cylindrical inner insert is in said closed position, and said dispensing chamber positioned outside said cylindrical outer shell when said cylindrical inner insert is in said open position, said dispensing chamber having a dispensing chamber height sufficient to allow one of the plurality of stacked mints to be removed from said cylindrical inner insert; and an alignment slot formed longitudinally into said insert sidewall adjacent said insert open bottom, said alignment slot engaging said vertical arm guide such that said cylindrical inner insert cannot rotate within said cylindrical outer shell.

10. A package assembly as described in claim 9, wherein said vertical arm guide comprises a vertical arm height sufficient to engage said alignment slot when said cylindrical inner shell is in said open position.

11. A package assembly as described in claim 9, further comprising:

a plurality of lower reinforcement arms formed on said shell bottom surface and in communication with said shell sidewall.

12. A package assembly as described in claim 11, wherein said vertical arm guide comprises:

a plurality of vertical arm guides formed longitudinally into said sidewall inner surface, each of said plurality of vertical arm guides formed as a vertical extension of one of said plurality of lower reinforcement arms.

13. A package assembly as described in claim 9, further comprising:

at least one retention element creating frictional resistance between said cylindrical inner insert and said cylindrical outer shell when said cylindrical inner insert is in said closed position.

14. A package assembly as described in claim 13, wherein said at least one retention element comprises a retention protrusion formed onto a slot side edge such that said control slot width is reduced in the location of said at least one retention protrusion.

15. A package assembly as described in claim 9, wherein said control pad includes a control pad height, said control slot height greater than said control pad height by an amount equal to said dispensing chamber height.

16. A package assembly as described in claim 9, wherein said dispensing chamber comprises a half transverse section removed from a portion of said insert sidewall.

17. A package assembly as described in claim 9, further comprising:

an upper flange section formed around said insert top surface, said upper flange section engaging said shell open top when said cylindrical inner insert is in said closed position.

18. A package assembly as described in claim 9, wherein said control pad includes a control pad height, said control slot height greater than said control pad height such that said dispensing chamber is exposed above said shell open top by an amount equal to one of the plurality of stacked mints when said cylindrical inner shell is in said open position.

19. A package assembly as described in claim 9, further comprising:

a plurality of upper reinforcement arms formed on said insert top surface.

20. A package assembly as described in claim 9, wherein said vertical control slot comprises a rounded slot upper edge, a rounded slot lower edge, and a pair of flat slot side edges.

* * * * *